United States Patent [19]

Sokol

[11] 4,020,016

[45] Apr. 26, 1977

[54] CLEANING COMPOSITIONS EFFECTIVE IN DISSOLVING SOAP CURD

[75] Inventor: Charles S. Sokol, Forest Park, Ohio

[73] Assignee: The Drackett Company, Cincinnati, Ohio

[22] Filed: Feb. 28, 1975

[21] Appl. No.: 554,034

[52] U.S. Cl. ..... 252/546; 252/89 R; 252/106; 252/180; 252/527; 252/DIG. 1; 252/DIG. 11; 252/DIG. 14

[51] Int. Cl.[2] ..... C11D 1/10; C11D 1/83

[58] Field of Search ..... 252/89, 180, 117, 527, 252/546, DIG. 1, DIG. 11, DIG. 14, 106

[56] References Cited

UNITED STATES PATENTS

| | | | |
|---|---|---|---|
| 2,808,435 | 10/1957 | Young | 260/534 |
| 2,989,484 | 6/1961 | Kirstahler et al. | 252/110 |
| 3,239,468 | 3/1966 | Herrick | 252/546 X |
| 3,309,321 | 3/1967 | McMaster | 252/546 X |
| 3,515,673 | 6/1970 | Kersnar et al. | 252/546 |
| 3,694,365 | 9/1972 | Castner | 252/106 |
| 3,697,431 | 10/1972 | Summerfeldt | 252/103 |
| 3,754,990 | 8/1973 | Teumac | 134/2 |
| 3,775,330 | 11/1973 | Batka et al. | 252/89 |
| 3,812,046 | 5/1974 | Lancz | 252/106 |
| 3,869,399 | 3/1975 | Collins | 252/118 |
| 3,883,447 | 5/1975 | Tokiwa et al. | 252/546 |
| 3,965,048 | 6/1976 | Murtaugh | 252/527 |

FOREIGN PATENTS OR APPLICATIONS 608,416 11/1960 Canada

OTHER PUBLICATIONS

"The Chemical Formulang" (H. Bennett), vol, XVI, 1971, Chemical Publishing Co., New York – p. 151.

Kastra, Def. Pub. of Ser. No. 182,883, filed Sept. 22, 1971, Published in 903 O.G.6 on Oct. 3, 1972, Def. Pub. No. T903,010.

*Primary Examiner*—P. E. Willis, Jr.

*Attorney, Agent, or Firm*—David J. Mugford; George A. Mentis; Samuel J. DuBoff

[57] ABSTRACT

Aqueous cleaning compositions, especially effective in dissolving soap curd, are provided which comprise in aqueous solution an ammonium, alkylamine or hydroxy-alkylamine salt of nitrilotriacetic acid, an alkylene polyamine polycarboxylic acid, or mixtures thereof, and one or more nonionic surfactants, wherein the alkylamine and hydroxy-alkylamine have a chain length of from 1 to 5 carbon atoms, the composition is substantially free of alkali metal ions, and the alkylene polyamine polycarboxylic acid has the formula $$(HOOCCH_2)_2N[(CH_2)_xNCH_2COOH]_yCH_2COOH$$

wherein $x$ and $y$ may each independently be from 1 to 4.

8 Claims, No Drawings

CLEANING COMPOSITIONS EFFECTIVE IN DISSOLVING SOAP CURD

This invention relates to cleaning compositions. More specifically, the invention relates to cleaning compositions which are more effective in dissolving soap curd, from various surfaces—especially bathroom tile surfaces found in the sink, bathtub, floor, wall, and toilet—than conventional cleaning compositions comprising scouring agents, soaps and the like.

Soap, although an excellent detergent, has the disadvantage that it reacts with the metallic ions in water to form an insoluble curd. This curd, formed from the calcium and magnesium ions of hard water and soap, together with small amounts of oil, grease, fatty substances from the body, or even hair grooming products, adheres to the surface of the sink or tub tile and tends to accumulate creating an unsightly and unhealthy environment in the bathroom. Most conventional cleaners require that the user expend a great deal of energy in applying and removing the soap curd with the aid of a washcloth or brush.

The cleaning compositions of the present invention are easier to use because they readily dissolve the soap curd deposits with a minimum amount of effort by the user.

In order to remove soap curd deposits, sequestering agents are utilized, which are well known in the prior art. U.S. Pat. No. 2,921,908 to McCune discloses a detergent composition comprising the alkaline salts of amino polycarboxylates as sequestering agents and organic phosphates, which prevent corrosion by the sequestering agents. U.S. Pat. No. 3,308,065 to Lesinski discloses a scale removal composition comprising the ammonia and amine salts of alkylene polyamine polycarboxylic acids as sequestering agents.

U.S. Pat. No. 3,454,500 to Lancashire discloses a soap curd dispersing mixture containing a fatty acid soap, a detergent and a water soluble salt of a sequestering agent. U.S. Pat. No. 3,679,592 to Schomburg discloses an aqueous cleaning composition for cleaning hard surfaces comprising an amine or ammonium salt of a film-forming polymer, a surfactant, and a scale inhibitor or sequestering agent. U.S. Pat. No. 3,591,509 to Parks et al. discloses a hard surface cleaning composition including a nonionic surfactant, a solvent, sequestrant, sodium carboxymethylcellulose and water. However, none of the above-mentioned prior art patents discloses the gelling problem associated with using salts of sequestering agents in dissolving soap curd, nor the importance of not having sodium ions present when attempting to dissolve the soap curd and also prevent such gel formation.

It has been recently disclosed in commonly-assigned U.S. Ser. No. 456,431 filed on Mar. 29, 1974 and entitled "Drain Cleaning Compositions", that combinations of certain anionic surfactant salts, amine salts of sequestrants and water having substantially no alkali metal ions are effective in overcoming this gelling problem. However, there is no disclosure as to the specific nonionic surfactants containing cleaning compositions disclosed by Applicant herein.

In accordance with this invention, an effective cleaning composition is one comprising:

a. at least about 1% by weight of a member selected from the group consisting of an ammonium, alkylamine or hydroxyalkylamine salt of nitrilotriacetic acid, an alkylene polyamine polycarboxylic acid, or mixtures thereof;

b. at least about 0.75% by weight of at least one nonionic surfactant characterized as having an HLB number of at least about 13.5; and c. up to about 98.25% by weight of water wherein the alkyl substituent of said alkylamine and hydroxyalkylamine has a chain length of from 1 to 5 carbon atoms and said composition is substantially free of sodium ions.

Preferably, the alkaline polyamine polycarboxcylic acid has the formula $$(HOOCCH_2)_2N[(CH_2)_xNCH_2COOH]_yCH_2COOH$$

wherein the values of $x$ and $y$ may vary independently from 1 to 4.

A preferred embodiment is one wherein the above composition contains at least about 2% by weight of said member in (a), at least about 1% by weight of said nonionic surfactant, and up to about 97% by weight of water.

Another preferred embodiment is one wherein the nonionic surfactant is selected from the group consisting of:

a. ethoxylated linear primary alcohols selected from those having the formula $$C_mH_{2m+1}O\ (CH_2CH_2O)_nH,$$

wherein $m$ can vary from 12 to 15 and $n$ is at least 12, and an additional alcohol characterized as being a clear liquid having an HLB number of 14, a freezing point of 1° C, a cloud point of 400° F, a pH of 6–8, and a specific gravity of 1.02 at 25° C;

b. ethoxylated linear secondary alcohols having the formula $$CH_3(CH_2)_mCH(CH_2)_pCH_3$$
$$\qquad\qquad | $$
$$\qquad\qquad O-(CH_2CH_2O)_nH,$$

wherein the sum of $m$ and $p$ is 9 to 13 and of $n$ is at least 12; and c. ethyoxylated octyl phenols having the formula

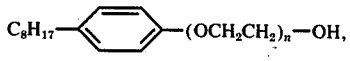

wherein $n$ is at least 9.

In another preferred embodiment, the monoethanolamine salt of ethylenediaminetetraacetic acid, and said nonionic surfactant is selected from the group consisting of said additional member ethoxylated linear primary alcohol having an HLB number of 14 of (a); an ethoxylated linear primary alcohol of (a) wherein $n$ is 12 and said alcohol has an HLB number of 14.5; and an ethoxylated octyl phenol of (c) wherein $n$ is 12 to 13 and said phenol has an HLB number of 14.6.

Another preferred embodiment is a cleaning composition comprising:

a. at least about 1% by weight of a member selected from the group consisting of an ammonium, alkylamine or hydroxyalkylamine salt of nitrilotriacetic acid, an alkylene polyamine polycarboxylic acid, or mixtures thereof;

b. at least about 0.5% by weight of at least one nonionic surfactant selected from the group consisting of:

1. ethoxylated linear secondary alcohols havng the formula $$CH_3(CH_2)_mCH(CH_2)_pCH_3$$
$$\quad\quad\quad\quad\quad\quad\quad\quad | $$
$$\quad\quad\quad\quad\quad\quad\quad\quad O-(CH_2CH_2O)_nH,$$

wherein the sum of $m$ and $p$ is 9 to 13 and said alcohol has an HLB number of 14.5 when $n$ is 12 or an HLB number of 18 when $n$ is 40;

2. an ethoxylated linear primary alcohol characterized as being a clear liquid having an HLB number of 13.1, a freezing point of 56°–63° C, a flash point of 375° F, a pH of 5–7, a pour point of 23° F, and a specific gravity of 1.0072 at 20° C; and 3. an ethoxylated octyl phenol having the formula

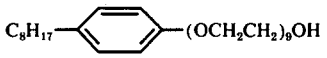

wherein said phenol has an HLB number of 13.5;

c. up to about 98.5% by weight of water wherein the alkyl substituent of said alkylamine and hydroxyalkylamine has a chain length of from 1 to 5 carbon atoms and said composition is substantially free of sodium ions. It is preferred to use the monoethanolamine salt of ethylenediaminetetraacetic acid, and said surfactant is that described in section (b)(2).

Another preferred embodiment is one comprising 1% by weight of the nonionic surfactant having an HLB number of 13.1 previously described in section (b)(2); 87.15% by weight of water; 3% by weight of monoethanolamine; 0.4% by weight of ethylenediamine; 3% by weight of ethylenediaminetetraacetic acid; 0.5% by weight of an antimicrobial agent; 0.04% by weight of a wetting agent; 5% by weight of a solvent mixture consisting of 61.54% by weight of isopropanol and 38.46% by weight of butyl cellosolve; and 0.15% by weight of a perfume.

Another preferred embodiment is one which additionally contains 0.01% by weight of 2-(4-thiazolyl)-benzimidazole as an antifungal agent, said wetting agent is a fluorocarbon, and said antimicrobial agent is a mixture of alkyl dimetyl- and alkyl dimethyl ethylbenzyl ammonium chlorides.

Although the present invention should not be limited to any particular theory, it is believed that the cleaning compositions of this invention react with soap curd to form a metal complex between the sequestering agent and the calcium or magnesium portion of the soap curd. Because this metal complex is soluble in water, the soap curd may then dissolve and be washed away. However along with formation of this metal complex, is the formation of the amine salt of the fatty acid portion of soap curd. It is believed that the amine salt forms a lyophilic colloidal system which is soluble in low concentrations. In solutions which are not extremely dilute, however, the salt is colloidal and forms an insoluble lyophilic amine soap gel. This gel forms on the surface of the dissolving soap curd and retards or prevents dissolution of the soap curd. Thus, although the insoluble soap curd can be dissolved by use of the ammonium, alkylamine, or hydroxy-alkylamine salt of the sequestering agent, it is prevented from being dissolved because of the formation of this surrounding insoluble gel.

Incorporation in the cleaning compositions of the present invention of the specific nonionic surfactants at the concentration levels disclosed herein eliminates the formation of this insoluble lyophilic amine soap gel. It is believed that the nonionic surfactant acts as a coupling agent between the amine salt of the fatty acid portion of the soap curd and water, so that it is more soluble and does not form this insoluble gel on the surface of the dissolving soap curd.

Further, it has been found that the compositions of this invention are not effective in dissolving soap curd if a substantial amount of sodium ions are present. These ions prevent this coupling effect of the nonionic surfactant, as described above, and allow the insoluble amine soap gel to be formed to prevent dissolution of the soap curd.

Numerous sequestering agents, those agents which have the capability of chelating or complexing mtal ions, are known in the prior art which are useful in the compositions of the present invention. The soluble salts of alkylene polyamine polycarboxylic acids are preferred because of their strong complexing action with calcium and magnesium ions in hard water and those particular salts which are more preferred, have the formula $$(HOOCCH_2)_2N[(CH_2)_xNCH_2COOH]_yCH_2COOH$$

wherein $x$ and $y$ may be independently from 1 to 7. The salts most preferred are those having the above formula where $x$ and $y$ may each independently be from 1 to 4; and nitrilotriacetic acid. Representative of some of the salts of amino polycarboxylates useful in the compositions of this invention are ethylenediaminetetraacetic acid, ethylene diamine triacetic acid, ethylene diaminetetraproprionic acid, and diethylenetriamine pentaacetic acid.

The ammonium, alkylamine (which is meant to also include alkylenediamine), hydroxy-alkylamine, or mixtures thereof, salts of these sequestering agents are preferred in the compositions of this invention; such as, for example, methylamine-, dimethylamine-, ethylamine-, ethylenediamine- diethylamine-, butylamine-, butylendiamine-, propylamine-, triethylamine-, trimethylamine-, the corresponding monoethanolamine-, diethanolamine-, triethanolamine-, isopropanolamine-, and propanol-amine salts Generally, the alkylamine and hydroxyalkylamine utilized in the compositions of this invention have a chain length of from 1 to 10 carbon atoms, however, those having from 1 to 5 carbon atoms are preferred.

The above-described sequestering agents and amines can be utilized in the compositions of this invention in all combinations, such as, for example, mixing of two or more alkylene polyamine polycarboxylic acids or an alkylamine and a hydroxy-alkylamine without departing from the spirit of this invention. It is preferred to use as a sequesterant the monoethanolamine salt of ethylenediaminetetraacetic acid.

The minimum quantity of both the amine salt of the sequestering agent and of the nonionic surfactant in the cleaning compositions of this invention have been generally found to be with certain exceptions about respectively, 1 and 0.75% by weight, where the HLB number of the surfactant is at least 13.5. If much less than these amounts are utilized in the compositions, then the insoluble lyophilic gel forms and prevents dissolution of the soap curd. If only slightly lesser amounts are utilized, then the time necessary for dissolution of the soap curd is increased and the amount of soap curd dissolved is decreased. Preferably, at least about 2% of said sequestering agent salt and at least about 1% of said surfactant are utilized. Generally, it has been found that up to about 5% of the sequestering agent and up to about 2% of the nonionic surfactant is sufficient to provide an effective cleaning composition. Greater amounts of each of these ingredients can be utilized in these cleaning compositions, however, the use of such greater amounts is less economical without significantly increasing the efficiency in cleaning of these compositions.

Many nonionic surfactants can be utilized in the cleaning compositions of this invention, as long as they function as coupling agents, as described above, and add no substantial quantity of sodium ions to the compositions. In addition to its unique coupling effect with the sequestering agent to eliminate gel formation, the surfactant provides a penetrating and wetting effect, so as to increase the rate at which the composition penetrates soap curd especially when fatty substances are also present. Generally, the classes of nonionic surfactants which have been found to be most effective at the above-mentioned concentration levels, with certain exceptions, are those having an HLB number of at least about 13.5. These may include the following:

a. ethoxylated linear primary alcohols such as the Neodol 25 series of surfactants made by Shell Chemical Company having the general formula $$C_mH_{2m+1}O(CH_2CH_2O)_nH,$$

where $m$ is 12 to 15 and $n$ is the last number in the surfactant name (for example, for Neodol 25-9, $n$ is 9). It has been found that such surfactants are effective where $n$ is at least 12 (e.g. Neodol 25-12). Additionally effective is Polytergent SL-62 made by the Olin Mathieson Co. believed to be an ethoxylated linear primary alcohol having more than about 8 moles of ethylene oxide in the molecule, and characterized as being a clear liquid having an HLB number of 14, a freezing point of 1° C, a cloud point of 400° F, a pH of 6–8 and a specific gravity of 1.02 at 25° C.

b. Ethoxylated linear secondary alcohols such as the Tergitol 15-S series of surfactants made by Union Carbide Corp. having the general formula $$CH_3(CH_2)_mCH(CH_2)_pCH_3$$
$$\quad\quad\quad\quad |$$
$$\quad\quad\quad\quad O-(CH_2CH_2O)_nH$$

where the sum of $m$ and $p$ is 9 to 13 and $n$ is the last number of the surfactant name. It has been found that such surfactants are effective where $n$ is at least 12 (e.g. Tergitol 15-S-12).

c. Ethoxylated octyl phenols such as the Triton X series of surfactants made by Rohm and Haas Company having the general formula

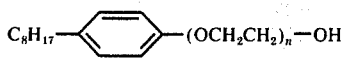

where $n$ is at least 9. Examples are Triton X-100 where $n$ is 9–10 and Triton X-102 where $n$ is 12–13. Triton X-114 where $n$ is 7–8 has not been found to be as effective.

As an exception to the above class of surfactants which has been found to be quite effective is Surfonic J-4 made by Jefferson Chemical Company. This compound is characterized as being a clear liquid having an HLB number of 13.1, a freezing point of 56°–63° C, a flash point of 375° F, a pH of 5–7, a pour point of 23° F, specific gravity of 1.0072 at 20° C, and is believed to be an ethoxylated linear primary alcohol estimated to contain 7 9 moles of ethylene oxide in the molecule. A virtually identical surfactant having an HLB number of 13.0 has also been found to be as effective is Polytergent SL-42 made of Olin Mathieson Company. It is generally thought that these surfactants also contain a coupling agent or hydrotrope to make them dissolve more quickly in water without forming gels. Most similar surfactants tend to form gels with water which significantly decreases their rate of solution. The hydrotrope or coupling agent in these surfactants might be in part causing the unexpected soap curd gel breakup.

It has also been found that certain of the above-mentioned surfactants are effective at concentrations even as low as about 0.5% by weight of the cleaning composition. For example, Tergitol 15-S-12 (having an HLB number of 14.5); Tergitol 15-S-40 (having an HLB number of 18); Surfonic J-4 (having an HLB number of 13.1); having proven to be effective at these low concentrations.

Some additional ingredients which may be included are effective amounts of antimicrobial agents such as a mixture of alkyl dimethyl benzyl ammonium chloride (50% $C_{12}$, 30% $CH_{14}$, 17% $C_{16}$, 3% $C_{18}$) and alkyl dimethyl ethyl benzyl ammonium chloride (60% $C_{14}$, 30% $C_{16}$, 5% $C_{12}$, 5% $C_{18}$) sold as BTC-2125 by The Onyx Chemical Company, or as Barquat 4520 by Lonza, Inc.; antifungicidal agents such as 2-(4-thiazolyl)-benzimi-dazole, sold by Merck & Co., Inc., as Metasol TK-100; wetting agents such as Zonyl FSN, a fluorocarbon nonionic surfactant sold by E. I. DuPont de Nemours and Co. (Inc.) having a flash point of 92° F and a density of 9.0 pounds per gallon; organic solvents for aiding in the dissolving of oils and grease which can include individually or mixtures of lower aliphatic monohydric alcohols (e.g. isopropanol, n-propanol, ethanol, sec-butanol, tert-butanol), lower akylene glycols (e.g. ethylene glycol, propylene glycol, butanediols, hexamethyleneglycol, etc.), and glycol ethers (e.g. glycol monoethyl ether, glycol monobutyl ether, diethyleneglycol monoethyl ether); perfumes; dyes; anti-soil redeposition agents or suspending agents (e.g. clays, carboxymethylcellulose, polyvinylalcohol, etc.); and solubilizers.

The following examples are presented to illustrate the present invention and are only exemplary and not limiting of the scope of the present invention.

EXAMPLE I

Effective cleaning compositions are given below for Formulations A, B and C having the weight percentages given below:

| | Formulation A | Formulation B | Formulation C |
|---|---|---|---|
| Water | 85.7932% | 86.90% | 86.91% |
| Sulfonic J-4 | 0.987% | 1.0% | 1.0% |
| Monoethanolamine | 2.962% | 3.0% | 3.0% |

-continued

| | Formulation A | Formulation B | Formulation C |
|---|---|---|---|
| Ethylenediamine | 0.395% | 0.4% | 0.4% |
| Ethylenediaminetetra-acidic acid | 2.962% | 3.0% | 3.0% |
| BTC-2125 (50% aq. sol.) | 0.494% | 0.5% | 0.5% |
| Zonyl FSN | 0.0395% | 0.04% | 0.04% |
| Solvent mixture containing 61.54% isopropanol and 38.46% butyl cellosolve | 6.170% | 5.0% | 5.0% |
| Metasol TK-100 | 0.0123% | 0.01% | — |
| Perfume | 0.185% | 0.15% | 0.15% |
| Dye | — | — | 0.00005% |

EXAMPLE II

A series of experiments were performed to evaluate the effectiveness of various types of nonionic surfactants as to their ability to break up gels formed from magnesium and/or calcium soap curd and an amine salt of a sequestering agent as given below.

1. Preparation of the Soap Curds

A batch of calcium soap curd was made by adding sixty grams of Procter and Gamble "Ambergranules" (88% active sodium soap) to approximately 2½ liters of water. The water was stirred and heated to approximately 120° F at which temperature the soap dissolved. Then a slight stoichiometric excess of calcium chloride, i.e. 10.17 grams of $CaCl_2$, was dissolved in about 100 grams of water and added dropwise with stirring to the hot soap solution to produce the insoluble soap curd. The precipitate was digested at 120° F for 1 hour, cooled and filtered. Then the precipitate was washed about 8 times with deionized water to remove sodium ions. Each washing consisted of adding about 2 liters of water, stirring with a motorized propeller blade for about 30 minutes and filtering. The precipitate was dired to constant weight in a 180° F oven. Using the same procedure, a batch of magnesium soap curd was made utilizing 19.78 grams of magnesium chloride, i.e. $MgCl_2 \cdot 6H_2O$, instead of calcium chloride.

2. Preparation of the Gels

If the acid form of the sequestering agent was used to prepare the gel, the following procedure was used. The required weight of basic alkylamine or hydroxyalkylamine as added to the required weight of water. The acid form of the sequestering agent was added and the solution was stirred until the acid was dissolved. If a salt of the sequestering acid was used, it was added to the water and the solution was stirred briefly to dissolve the salt. The insoluble soap curd was added and the solution was heated with stirring until the soap dissolved. As the soap dissolved, the gel was produced.

3. Gel Break Up Test Procedure

For a specific test involving initially 0.25 grams of a given surfactant, ninety grams of the gel was added to a 100 ml. beaker. Its viscosity was measured ten times on a Brookfield Model RV Viscometer using a number 4 viscometer spindle and a speed of 100 R.P.M. Since the apparent viscosity of the gel is affected by spindle size, rotation speed and number of rotations, the same procedure was used on all tests. The spindle was rotated 10 cycles with the clutch holding the viscosity indicator at zero, the clutch was released and the viscometer was rotated an additional 15 cycles at which time the clutch was engaged and the apparent viscosity was measured. If the apparent viscosity appeared to be changing, further readings were taken. For a given test number involving a specific surfactant, additional amounts of the same surfactant were added to the same ninety gram gel sample and apparent viscosity was again measured. Viscosity readings were taken with the following quantities of surfactant present: 0.25 g., 0.50 g., 0.75 g., 1.00 g., 1.50 g., 2.00 g. If there was only slight variation in the values of apparent viscosity, only 5 readings were performed. Ordinarily 10 were performed. If the apparent viscosity appeared to be changing, further readings were taken. More specifically, if the numerical values of the viscosity readings were greater than 10 and there was less than a 0.4 difference between the high and low values, then only 5 readings were performed, as shown below:

| Average of Viscosity Readings | Minimum Difference Between High and Low Values |
|---|---|
| >10 | 0.4 |
| 5–10 | 0.3 |
| 2–5 | 0.2 |
| <2 | 0.1 |

Since the gels produced by the two batches of calcium soap curd had different viscosities and different resistances to break up by the surfactants, several tests were performed using calcium gels prepared from each batch of calcium soap curd.

The test results are shown in Table I below for 30 tests.

TABLE I

| Test No. | Surfactant | HLB Number | Effective In Gel Breakup? |
|---|---|---|---|
| 1 | Surfonic J-4 | 13.1 | yes |
| 2 | — | — | — |
| 3 | GAFAC RA-600 | — | yes |
| 4 | Triton X-100 | 13.5 | poorly |
| 5 | Triton X-114 | 12.4 | no |
| 6 | Triton X-102 | 14.6 | yes |
| 7 | Tergitol 15-S-7 | 12.1 | no |
| 8 | Tergitol 15-S-5 | 10.5 | no |
| 9 | Neodol 25-7 | 12.0 | no |
| 10 | Neodol 25-9 | 13.1 | no |
| 11 | Neodol 25-12 | 14.4 | yes |
| 12 | Polytergent SL-62 | 14.0 | yes |
| 13 | Tergitol 15-S-12 | 14.5 | yes |
| 14 | Tergitol 15-S-40 | 18.0 | yes |
| 15 | Tergitol 15-S-12 | 14.5 | yes |
| 16 | Triton X-114 | 12.4 | no |
| 17 | 50:50 mixture Triton X-102 and Neodol 25-12 | 14.5 | yes |
| 18 | surfonic J-4 | 13.1 | Yes |
| 19 | Surfonic J-4 | 13.1 | yes |
| 20 | Surfonic J-4 | 13.1 | no |
| 21 | Tergitol 15-S-12 | 14.5 | no |
| 22 | Surfonic J-4 | 13.1 | yes |
| 23 | Triton X-100 | 13.5 | yes |
| 24 | Surfonic J-4 | 13.1 | yes |
| 25 | Triton X-100 | 13.5 | poorly |
| 26 | Surfonic J-4 | 13.1 | yes |
| 27 | Surfonic J-4 | 13.1 | yes |
| 28 | Triton X-100 | 13.5 | yes |
| 29 | Surfonic J-4 | 13.1 | yes |
| 30 | Polytergent SL-42 | 13.0 | yes |

| Test No. | Apparent Viscosity (centiposes)/20 At Each Measured Surfactant Weight (Grams) 0 | 0.25 | 0.50 | 0.75 | 1.00 | 1.25 | 1.50 | 2.00 |
|---|---|---|---|---|---|---|---|---|
| 1 | 43.1 | >100 | 31.4 | 10.0 | 2.3 | 1.2 | 0.8 | 0.5 |
| 2 | 0.2 | — | — | — | — | — | — | — |
| 3 | 43.8 | >100 | 34.4 | 4.1 | 1.4 | 0.7 | 0.5 | 0.4 |
| 4 | 44.0 | >100 | 54.1 | 36.0 | 24.2 | 7.9 | 3.5 | 1.8 |
| 5 | 40.6 | ≈100 | 81.8 | 56.1 | 50.6 | — | 54.5 | 38.1 |
| 6 | 50.9 | >100 | 40.9 | 19.4 | 3.1 | 1.5 | 0.8 | 0.7 |

TABLE I-continued

| | | | | | | | | |
|---|---|---|---|---|---|---|---|---|
| 7 | 50.1 | ≈100 | ≈95 | 68.2 | 50.7 | 48.6 | 44.8 | 18.7 |
| 8 | 51.2 | 29.3 | 33.5 | 25.8 | 14.8 | 13.0 | 13.5 | 15.2 |
| 9 | 53.3 | >100 | >100 | 72.9 | 69.3 | 67.2 | 69.3 | 59.8 |
| 10 | 45.3 | 79.2 | ≈92 | 68.1 | 37.8 | 36.3 | 30.0 | 12.7 |
| 11 | 47.2 | 89.4 | 41.0 | 7.1 | 1.9 | 1.2 | 0.7 | 0.5 |
| 12 | 51.9 | 79.5 | 22.3 | 3.1 | 1.3 | 0.8 | 0.5 | 0.4 |
| 13 | 49.5 | 73.9 | 18.6 | 2.2 | 1.0 | 0.6 | 0.5 | 0.3 |
| 14 | >100 | 8.8 | 1.1 | 0.8 | 0.5 | — | 0.4 | 0.5 |
| 15 | >100 | 25.4 | 2.1 | 0.7 | 0.5 | — | 0.4 | 0.3 |
| 16 | >100 | ≈100 | 47.6 | 37.3 | 39.9 | — | 19.5 | 11.0 |
| 17 | >100 | 37.8 | 6.7 | 1.9 | 1.0 | 1.0 | 0.6 | 0.6 |
| 18 | >100 | 32.0 | 6.0 | 1.5 | 0.7 | — | 0.5 | 0.4 |
| 19 | 21.0 | 41.8 | 30.5 | 4.3 | 1.6 | — | 0.6 | 0.3 |
| 20 | 17.2 | 11.7 | 10.1 | 9.1 | 8.9 | 8.7 | 8.2 | 6.1 |
| 21 | 14.1 | 12.0 | 11.5 | 11.4 | 11.4 | 9.7 | 9.0 | 7.0 |
| 22 | 56.7 | >100 | 31.1 | 1.4 | 0.5 | 0.4 | 0.4 | 0.4 |
| 23 | 56.5 | >100 | 39.6 | 3.4 | 1.4 | 1.1 | 1.1 | 1.3 |
| 24 | >100 | 37.2 | 6.9 | 1.7 | 1.0 | 0.9 | 0.5 | 0.5 |
| 25 | >100 | 63.2 | 33.1 | 18.5 | 5.6 | 2.6 | 1.8 | 1.1 |
| 26 | >100 | 30.3 | 5.9 | 1.5 | 0.9 | 0.7 | 0.6 | 0.4 |
| 27 | >100 | 1.1 | 0.5 | 0.5 | 0.5 | — | 0.5 | 0.4 |
| 28 | ≈78 | 1.6 | 0.8 | — | 0.6 | — | 0.5 | 0.5 |
| 29 | 60.8 | 5.1 | 1.3 | 0.7 | 0.6 | — | 0.5 | 0.4 |
| 30 | >100 | 38.4 | 15.6 | 2.8 | 1.4 | 1.0 | 0.7 | 0.5 |

Notes For Table I:

1. Test 2 was a control involving only a viscosity measurement on deionized water (no gel formation).
2. Test 3 was performed using an anionic surfactant called Gafac RA-600 (made by GAF Corp.) which is effective in gel breakup as a reference for comparison.
3. Sequesterant contained in 90 rams of test gel sample: Tests 1,3–19, 22–26, and 30 contained 2.24 grams of MEA (monoethanolamine) in combination with 1.80 grams of EDTA (ethylenediaminetetraacetic acid). Tests 20 and 21 each contained 2.45 grams of $Na_4EDTA$. Tests 18 and 19 additionally contained 0.06 and 0.58 grams of NaCl, respectively. Tests 27 and 28 each contained 2.24 grams of EN (98% active ethylenediamine) in combination with 1.80 grams of EDTA. Test 29 contained 2.44 grams of MEA in combination with 1.97 grams of NTA (nitrilotriacetic acid).
4. Soap Curd contained in 90 grams of test gel sample: Tests 1,3–21, 26–28, and 30 contained 3.22 grams of calcium soap curd. Tests 22 and 23 contained 3.22 grams of magnesium soap curd. Tests 24 and 25 contained mixture of 2.50 grams of calcium soap curd and 0.63 grams of magnesium soap curd (i.e. 4:1 calcium/magnesium ratio). Test 29 contained 3.07 grams of calcium soap curd.

The given weights of surfactant are added to 90 grams of test gel and the percentage of surfactant in each gel test is as shown below:

| Weight of Surfactant | Percentage of Surfactant |
|---|---|
| 0.25 g. | 0.278% |
| 0.50 g. | 0.553% |
| 0.75 g. | 0.827% |
| 1.00 g. | 1.10% |
| 1.25 g. | 1.37% |
| 1.50 g. | 1.64% |
| 2.00 g. | 2.18% |

DISCUSSION

Since the break up of a gel is accompanied by a decrease in viscosity, it was decided to use apparent (relative) viscosity as the measured parameter. The first batch of calcium soap curd was used to prepare the calcium soap-EDTA gel in Tests 1 to 13. All subsequent tests using calcium soap-EDTA gels were prepared from the second batch of calcium soap curd. Comprison of Tests 1 and 26 and also Tests 13 and 15 show that the gels prepared from the second batch of calcium saop curd are easier to break up, which is due to the extreme difficulty in preparing gels of identical behavior from different samples of soap curd.

Table II below shows an unexpected correlation between gel breakup efficacy and HLB (hydrophilic-lipophilic balance) number. A reading in Table I of 5 or less with 1 gram or less surfactant is considered to be sufficiently low to indicate significant gel breakup.

TABLE II

HLB-Gel Breakup Correlation (Against Calcium Gels)

| Test No.(s) | Surfactant | Surfactant Type | HLB | Efficacious |
|---|---|---|---|---|
| 1, 26 | Surfonic J-4 | Proprietary | 13.1 | Yes |
| 12 | Polytergent SL-62 | Proprietary | 14.0 | Yes |
| 5 | Triton X-114 | Octyl Phenol | 12.4 | No |
| 4 | Triton X-100 | Octyl Phenol | 13.5 | Poor |
| 6 | Triton X-102 | Octyl Phenol | 14.6 | Yes |
| 8 | Tergitol 15-S-5 | Linear Alcohol | 10.5 | No |
| 7 | Tergitol 15-S-7 | Linear Alcohol | 12.1 | No |
| 13,15 | Tergitol 15-S-12 | Linear Alcohol | 14.5 | Yes |
| 14 | Tergitol 15-S-40 | Linear Alcohol | 18.0 | Yes |
| 9 | Neodol 25–7 | Secondary Alcohol | 12.0 | No |
| 10 | Neodol 25–9 | Secondary Alcohol | 13.1 | No |
| 11 | Neodol 25–12 | Secondary Alcohol | 14.4 | Yes |
| 30 | Polytergent SL-42 | Proprietary | 13.0 | Yes |

As can be seen from Table II, all nonionic surfactants tested with HLB values of 14.0 or greater are effective at breaking up the calcium soap curd-EDTA salt gel; Triton X-100, at HLB 13.5, breaks up the gel poorly and surprisingly, Surfonic J-4, at HLB value 13.1 is also effective at breaking the gel. From the results of the Tergitol series (see Tables I and II), one sees that the gel breakup property increases with increasing HLB number.

Tests 22 and 25 confirm that these surfactants will also break up magnesium gels and magnesium-calcium gels. The mixed magnesium-calcium gels used in the test contain a 1:4 magnesium/calcium ratio. Typically, hard water contains from 1:3 to 1:4 magnesium/calcium ratios. Test 17 shows that mixture of effective surfactants are also effective but not synergistic. Tests 18 and 19 show that in the presence of increasing quantities of sodium ion, the gel break up ability decreases but is still sufficiently effective. However, Tests 20 and 21 show that if the sodium EDTA salt is used in place of an amine EDTA salt, the surfactant will not sufficiently break up the gel. Tests 27, 28 and 29 exemplify the effectiveness of using EN-EDTA and MEA-NTA sequestrant salts in combination with nonionic surfactants in the cleaning compositions. Tests 14, 15, 27, 28 and 29 show significant gel breakup using only 0.5 grams of surfactant.

What is claimed is:

1. A soap curd dissolving cleaning composition consisting essentially of:

a. from about 1–5% by weight of a member selected from the group consisting of an ammonium, alkylamine or hydroxyalkylamine salt of nitrilotriacetic acid, an alkylene polyamine polycarboxylic acid, or mixtures thereof, wherein said alkylene polyamine polycarboxylic acid has the formula $$(HOOCCH_2)_2N[(CH_2)_xNCH_2COOH]_yCH_2COOH$$

wherein the values of $x$ and $y$ may vary independently from 1 to 7, b. from about 0.75–2% by weight of at least one nonionic surfactant characterized as having an HLB number of at least about 13.5 selected from the group consisting of:

1. ethoxylated linear primary alcohols having the formula $$C_mH_{2m+1}O\ (CH_2CH_2O)_nH,$$

wherein $m$ can vary from 12 to 15 and $n$ is at least 12;

2. an ethoxylated linear primary alcohol which is a clear liquid having an HLB number of 14, a freezing point of 1° C, a cloud point of 400° F, a pH of 6–8, and a specific gravity of 1.02 at 25° C;

3. ethoxylated linear secondary alcohols having the formula $$CH_3(CH_2)_mCH(CH_2)_pCH_3$$
$$\quad\quad\quad\quad\quad\quad | $$
$$\quad\quad\quad\quad O-(CH_2CH_2O)_nH,$$

wherein the sum of $m$ and $p$ is 9 to 13 and of $n$ is at least 12; and 4. ethoxylated octyl phenols having the formula

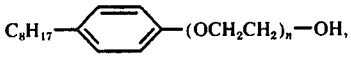

wherein $n$ is at least 9; and c. up to about 98.25% by weight of water wherein the alkyl substituent of said alkylamine and hydroxyalkylamine has a chain length of from 1 to 5 carbon atoms and said composition is substantially free of sodium ions.

2. The composition of claim 1 wherein said alkylene polyamine polycarboxylic acid has the formula $$(HOOCCH_2)_2N[(CH_2)_xNCH_2COOH]_yCH_2COOH$$

wherein the values of $x$ and $y$ may vary independently from 1 to 4.

3. The composition of claim 1 wherein said composition contains at least about 2% by weight of said member in (a), at least about 1% by weight of said nonionic surfactant, and up to about 97% by weight of water.

4. The composition of claim 1 wherein said member is the monoethanolamine salt of ethylenediaminetetraacetic acid, and said nonionic surfactant is selected from the group consisting of said ethoxylated linear primary alcohol (2) having an HLB number of 14; an ethoxylated linear primary alcohol (1) wherein $n$ is 12 and said alcohol has an HLB number of 14.5; and an ethoxylated octyl phenol (4) wherein $n$ is 12 to 13 and said phenol has an HLB number of 14.6.

5. A soap curd dissolving cleaning composition consisting essentially of:

a. from about 0.75–2% by weight of a member selected from the group consisting of an ammonium, alkylamine or hydroxyalkyl amine salt of nitrilotriacetic acid, an alkylene polyamine polycarboxylic acid, or mixtures thereof;

b. from about 0.5 to 2% by weight of at least one nonionic surfactant selected from the group consisting of:

1. ethoxylated linear secondary alcohols having the formula $$CH_3(CH_2)_mCH(CH_2)_pCH_3$$
$$\quad\quad\quad\quad\quad\quad | $$
$$\quad\quad\quad\quad O-(CH_2CH_2O)_nH,$$

wherein the sum of $m$ and $p$ is 9 to 13 and said alcohol has an HLB number of 14.5 when $n$ is 12 or an HLB number of 18 when $n$ is 40;

2. an ethoxylated linear primary alcohol which is a clear liquid having an HLB number of 13.1, a freezing point of 56°–63° C, a flash point of 375° F, a pH of 5–7, a pour point of 23° F, and a specific gravity of 1.0072 at 20° C; and 3. an ethoxylated octyl phenol having the formula

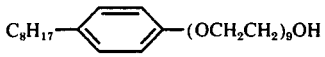

wherein said phenol has an HLB number of 13.5;

c. up to about 98.5% by weight of water wherein the alkyl substituent of said alkylamine and hydroxyalkylamine has a chain length of from 1 to 5 carbon atoms and said composition is substantially free of sodium ions.

6. The cleaning composition of claim 5 wherein said member is the monoethanolamine salt of ethylenediaminetetraacetic acid, and said surfactant is that described in section (b)(2).

7. The cleaning composition of claim 5 consisting essentially of 1% by weight of the surfactant described in section (b)(2); 87.15% by weight of water; 3% by weight of monoethanolamine; 0.4% by weight of ethylenediamine; 3% by weight of ethylenediaminetetraacetic acid; 0.5% by weight of a mixture of alkyl dimethyl benzyl ammonium chloride (50% $C_{12}$, 30% $CH_{14}$, 17% $C_{16}$, 3% $C_{18}$) and alkyl dimethyl ethyl benzyl ammonium chloride (60% $C_{14}$, 30% $C_{16}$, 5% $C_{12}$, 5% $C_{18}$); 0.04% by weight of a fluorocarbon nonionic surfactant having a flash point of 92° F and a density of 9.0 pounds per gallon; 5% by weight of a solvent mixture consisting of 61.54% by weight of isopropanol and 38.46% by weight of butyl cellosolve; and 0.15% by weight of a perfume.

8. The cleaning composition of claim 7 additionally containing 0.01% by weight of 2-(4-thiazolyl)-benzimidazole as an antifungal agent.

* * * * *

UNITED STATES PATENT OFFICE

CERTIFICATE OF CORRECTION

PATENT NO. : 4,020,016

DATED : April 26, 1977

INVENTOR(S) : Charles S. Sokol

It is certified that error appears in the above-identified patent and that said Letters Patent are hereby corrected as shown below:

In Claim 5, Column 12, Line 5, delete "0.75-2%" and insert in place thereof -- 1-5% -- .

Signed and Sealed this

*fifth* Day of *July 1977*

[SEAL]

*Attest:*

RUTH C. MASON
*Attesting Officer*

C. MARSHALL DANN
*Commissioner of Patents and Trademarks*